US010739086B2

(12) United States Patent
Aouizerate et al.

(10) Patent No.: US 10,739,086 B2
(45) Date of Patent: Aug. 11, 2020

(54) HEAT EXCHANGER AND TURBINE ENGINE COMPRISING SUCH AN EXCHANGER

(71) Applicant: SAFRAN AIRCRAFT ENGINES, Paris (FR)

(72) Inventors: Gilles Yves Aouizerate, Moissy-Cramayel (FR); Benjamin Boudsocq, Moissy-Cramayel (FR); Gerard Philippe Gauthier, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 124 days.

(21) Appl. No.: 15/521,864

(22) PCT Filed: Oct. 23, 2015

(86) PCT No.: PCT/FR2015/052855
§ 371 (c)(1),
(2) Date: Apr. 25, 2017

(87) PCT Pub. No.: WO2016/066935
PCT Pub. Date: May 6, 2016

(65) Prior Publication Data

US 2017/0321972 A1 Nov. 9, 2017

(30) Foreign Application Priority Data

Oct. 30, 2014 (FR) ..... 14 60461

(51) Int. Cl.
*F28F 13/00* (2006.01)
*F28F 27/00* (2006.01)
*F28D 21/00* (2006.01)

(52) U.S. Cl.
CPC ..... *F28F 13/00* (2013.01); *F28F 27/00* (2013.01); *F28D 2021/0021* (2013.01); *F28F 2215/14* (2013.01); *F28F 2255/02* (2013.01)

(58) Field of Classification Search
CPC ..... F28F 13/00; F28F 27/00; F28F 2215/14; F28F 2255/02; F28D 2021/0021
(Continued)

(56) References Cited

U.S. PATENT DOCUMENTS 6,628,522 B2 * 9/2003 Trautman ..... F28F 13/02 165/185
7,453,187 B2 * 11/2008 Richards ..... F02B 75/34 310/339
(Continued)

OTHER PUBLICATIONS

International Search Report with English language translation dated Mar. 3, 2016, PCT Application No. PCT/FR2015/052855.

*Primary Examiner* — Tho V Duong
*Assistant Examiner* — Raheena R Malik
(74) *Attorney, Agent, or Firm* — Womble Bond Dickinson (US) LLP

(57) ABSTRACT

The invention relates to a heat exchanger (10) for heat-exchange between a first fluid and a second fluid, comprising a membrane separating the two fluids and a heat-conductive element (17) in thermal contact with the membrane and with the first fluid, characterised in that said heat-conductive element (17) moves between an active position and an inactive position, such that the capacity of heat exchange with the first fluid is weaker in the inactive position than in the active position. The exchanger is applied, in particular, for the cooling of fluid in the secondary stream of a turbofan.

7 Claims, 2 Drawing Sheets

(58) Field of Classification Search
USPC ..... 165/272
See application file for complete search history.

(56) References Cited

U.S. PATENT DOCUMENTS

| | | | | |
|---|---|---|---|---|
| 7,926,471 | B2 * | 4/2011 | Freese, V | F02M 26/32 123/568.12 |
| 8,339,787 | B2 * | 12/2012 | Tsai | G06F 1/206 165/104.33 |
| 8,561,386 | B2 * | 10/2013 | Mons | F01D 25/12 60/266 |
| 2003/0043531 | A1 | 3/2003 | Trautman et al. | |
| 2009/0223648 | A1 * | 9/2009 | Martin | F28F 1/40 165/86 |
| 2009/0314265 | A1 | 12/2009 | Freese | |
| 2011/0030337 | A1 | 2/2011 | Mons | |
| 2013/0255931 | A1 * | 10/2013 | Arnett | F28F 27/00 165/287 |
| 2013/0259640 | A1 * | 10/2013 | Dimascio | F16K 31/002 415/1 |
| 2015/0235920 | A1 * | 8/2015 | Skinner | H01L 23/467 257/692 |

* cited by examiner

HEAT EXCHANGER AND TURBINE ENGINE COMPRISING SUCH AN EXCHANGER

FIELD OF THE INVENTION

The present invention relates to the field of heat exchangers and the application thereof in order to cool fluids of a turboshaft engine, such as a turbojet engine or turboprop engine, the exchanger being arranged in particular on a wall of the turboshaft engine or alternatively of the nacelle thereof.

PRIOR ART

The prior art comprises in particular US-A1-2011/030337, US-A1-2009/314265 and US-A1-2003/043531.

It is known in multi-flow turbojet engines to arrange heat exchangers, such as air-to-air surface exchangers, in the secondary flow path for cooling fluids circulating in the engine, for example air taken in the region of the compressors. It is a question of taking advantage of the high heat transfer coefficients resulting from the high-speed circulation of a cold external air flow in this flow path.

However, in compensation, the elements of the exchanger which are in contact with this flow in order to produce the heat exchanges cause losses of pressure in the flow. These losses adversely affect the performance of the engine, all the more so since the cooling requirement does not necessarily coincide with the flight phases having high weighting from the point of view of performance. Thus during the cruising-type flight phases the engine does not necessarily require very significant cooling, whereas the take-off phases last for only a few minutes but on the other hand result in a major cooling requirement.

The applicant has set itself the aim of reducing the losses of pressure which the heat exchanger is liable to create on the secondary air flow when the cooling requirement is less. More generally, the applicant has set itself the aim of producing a heat exchanger, of which the heat exchanges between the moving fluids can be controlled so as to reduce the impact of the parts of the exchanger on the flow characteristics of one of the fluids when desired.

DISCLOSURE OF THE INVENTION

These aims are achieved by a heat exchanger for heat exchange between a first fluid and a second fluid, comprising a membrane separating the two fluids and a heat-conductive element in thermal contact with both the membrane and the first fluid, said heat-conductive element being movable between an active position and an inactive position such that the capacity of heat exchange with the first fluid is less in the inactive position than in the active position, characterised in that said element is prestressed in the active position and the transition from the active position to the inactive position is achieved by buckling of the membrane.

The solution of the invention therefore consists in modifying the exposure of the heat-conductive element relative to the first fluid so as to reduce the flow resistance generated thereby.

In the present application, "buckling" of the membrane is understood to mean the fact that the membrane is subjected to a force, preferably a compressive force, which brings about bending and deformation of the membrane in general in a direction perpendicular to the direction of application of the force (transition from a compression state to a bending state).

Said element is preferably prestressed in compression, along an axis that is substantially parallel to an axis about which the membrane bends during the buckling thereof.

According to one embodiment, the heat-conductive element is in the form of a blade. The blade is rigidly connected to the membrane by a connecting edge and, in the active position, is moved away from the membrane so as to be in contact with the first fluid by the two faces thereof.

More particularly, the blade in the inactive position is arranged by one face close to the membrane. In this position, only one face of the blade is preferably in contact with the first fluid, which reduces the heat exchanges with the fluid.

Furthermore, the blade in the active position has a curved shape which moves away from the membrane at the connecting edge. Thus, the heat exchanges are controlled simply and effectively between these two positions.

According to another feature, the connecting edge is rectilinear and the blade is curved around the connecting edge in the active position. In particular, the transition from the active position to the inactive position is achieved by deforming the membrane along the connecting edge connecting the blade to the membrane. The deformation of the membrane forming a support for the blade results in a deformation of the blade between two states: a first state in which the blade is curved in a direction parallel to the line formed by the connecting edge, and a second state in which the blade is curved perpendicularly to the connecting edge. In particular, the blade matches the shape of the membrane when the latter is in the shape of a portion of a cylinder.

According to another feature, the deformation of the membrane is achieved by applying a force that is parallel to the plane of the membrane. This force is advantageously a compressive force. This deformation is preferably achieved by the force of an element forming a piston.

The invention also relates to the application of the heat exchanger in order to cool a fluid in a turboshaft engine, such as a turbojet engine.

PRESENTATION OF THE FIGURES

The invention will be better understood, and other objects, details, features and advantages thereof will become more clearly apparent, on reading the following detailed explanatory description of an embodiment of the invention which is given by way of a purely illustrative, non-limiting example with reference to the accompanying schematic drawings. In these drawings.

DETAILED DESCRIPTION OF AN EMBODIMENT OF THE INVENTION

Figure 1:
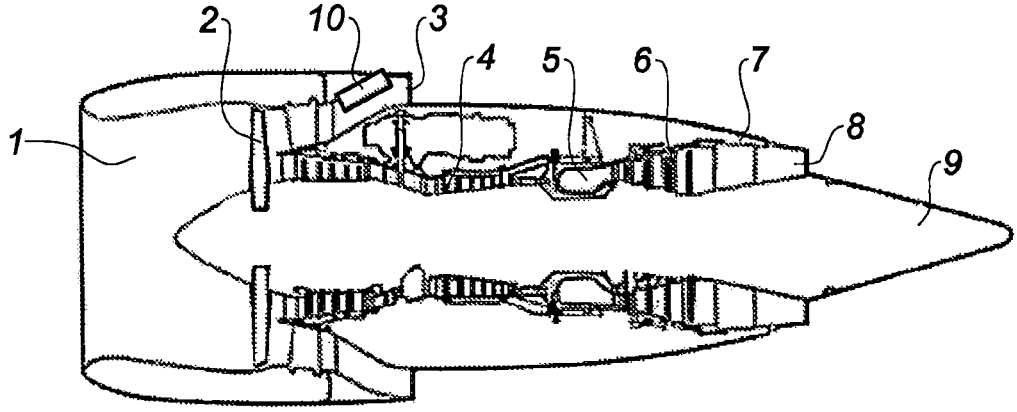
FIG. 1 is a schematic view of a turbofan engine in which the heat exchanger of the invention can be integrated.

A turbojet engine comprises an air intake duct, upstream, through which the air is drawn into the engine, and an exhaust nozzle downstream through which the hot gases produced by the combustion of a fuel are discharged in order to supply a portion of the thrust, at least. Between the intake duct and the gas exhaust nozzle, the air drawn in is compressed by compression means, is heated and expanded in turbines which drive the compression means. Multi-flow turbojet engines also comprise at least one fan rotor which displaces a large mass of air, forming the secondary flow and providing the main part of the thrust, the primary flow being that portion of the air flow drawn in which is heated then expanded in the turbine before being discharged through the primary-flow exhaust nozzle. The turbojet engine of FIG. 1 is a twin-spool turbofan engine having, in succession in the direction of travel of the air in the engine, an air intake 1 upstream, a fan 2 delivering the air into an annular secondary-flow channel 3 and towards the primary-flow compressors 4 in the centre, the combustion chamber 5, and the turbine stages 6. Here the secondary flow is discharged separately through a secondary-flow exhaust nozzle. In the downstream portion of the engine, the rotors are supported by the exhaust casing 7. The primary flow is discharged through the primary-flow exhaust nozzle 8 downstream of the exhaust casing. The flow is annular, and the flow path of the primary flow is defined internally by the exhaust cone 9. The cone 9 is a hollow, substantially frustoconical-shaped part that is rigidly connected to the exhaust casing.

As mentioned further above, it is known to arrange a heat exchanger 10 in the secondary flow path 3 with the aim of cooling a fluid, which may be air taken from the compressor. An example of an exchanger capable of performing this function comprises a circuit in which the fluid to be cooled circulates. This circuit is in thermal contact with a heat-exchange membrane for heat exchange with the cold fluid circulating in the secondary flow path. Fins are generally provided on the membrane on that side of the exchange surface which is turned towards the cold flow in order to increase the capacity of heat exchange and to improve the cooling. These fins extend perpendicularly to the membrane in the secondary flow and create a loss of pressure therein.

In order to control the loss of pressure in the secondary flow, it is proposed according to the invention to make the fins movable between an active position of optimum heat exchange and a position designated as inactive, in which the heat exchanges are less efficient but in which the loss of pressure caused by the presence of the exchanger is reduced.

The exchanger 10 of the invention is shown in FIGS. 2 to 6. It comprises a casing having a bottom wall 11, a plurality of partitions 13 which are perpendicular to the bottom wall 11 and define between them and the bottom a plurality of channels 12 which are parallel to one another. These channels are covered by membranes 15 and communicate with a first collector 12*a* at one end and a second collector 12*b* at the other end of the casing. The casing is supplied with fluid by the first collector. After having circulated in the channels 12, the fluid can be recovered by the second collector 12*b* at the other end of the casing. The casing is intended to be placed, here along the secondary flow path 3 of the turbojet engine, so that the membranes are in contact with a fluid at a different temperature for a heat exchange between the fluid circulating in the channels and the fluid sweeping over the outer surface of the membranes. In the application intended here, the fluid circulating on the outside of the channels is the first fluid, and the fluid circulating in the channels is the second fluid. The first fluid is the cold secondary flow, and the second fluid is the fluid to be cooled.

To improve the heat exchanges between the two fluids, heat-conductive elements 17 are mounted on the membranes 15 on the side of the first fluid; these are metal blades 171 which offer a large contact surface and a reduced space requirement. These blades 171 are fixed to the membranes 15 along a connecting edge 173 by welding or brazing, for example. The two faces of larger dimensions of the blades 171 constitute the main surfaces of heat exchange with the first fluid into which they are immersed. Advantageously, the connecting edges are parallel to the direction of flow of the fluid with which the blades are in heat exchange.

According to the invention, these blades 171 are movable between an active position in which they are raised relative to the membrane supporting them and an inactive position in which they are folded down against the membrane. By being raised, the two faces thereof are presented to the first fluid for maximum heat transfer between the two fluids. In the inactive position, by being flattened against the membrane or at the very least extended along it, the blades 171 have a lower heat exchange capacity than in the active position because the exchange surface is limited to one face of the blade. The flow resistances are also lower than in the active position for the same reason.

One of the aspects of the invention relates to the means of making the blades 171 transition from one position to the other.

The membranes 15 covering the channels 12 are fixed on one side 151 along a partition 13, and on the other on the opposing partition 13. These membranes 15 are rigidly connected to an element 153 forming a piston. The piston-forming element 153 is movable within an actuator chamber 131 formed along the partition. The piston is movable in parallel with the plane of the membrane, in a transverse direction relative to the channels 12. The movement of the piston is controlled by a control fluid supplied by a duct 133 at the entry to the chamber. More generally, the actuator formed of the piston and the actuator chamber comprises any driving element capable of exerting a compressive force on the membrane in parallel with the plane thereof. The actuating energy of the driving element or of the actuator may be pressurised air taken for example from the last stages of the compressor.

Figure 2:
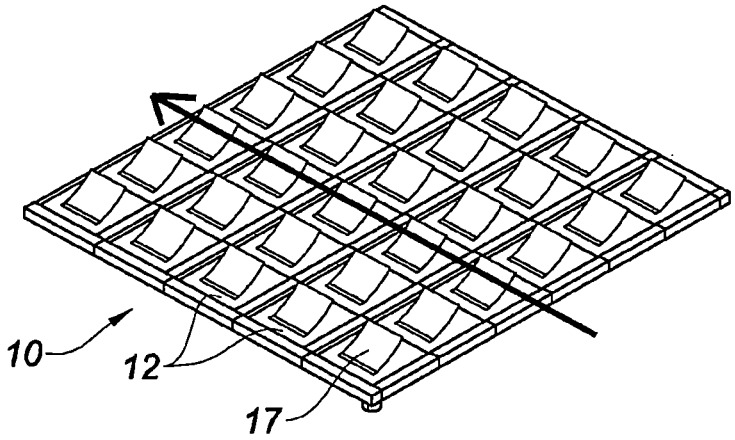
FIG. 2 shows the heat exchanger according to the invention in a state in which the heat-conductive elements are raised into the active position.
Figure 3:
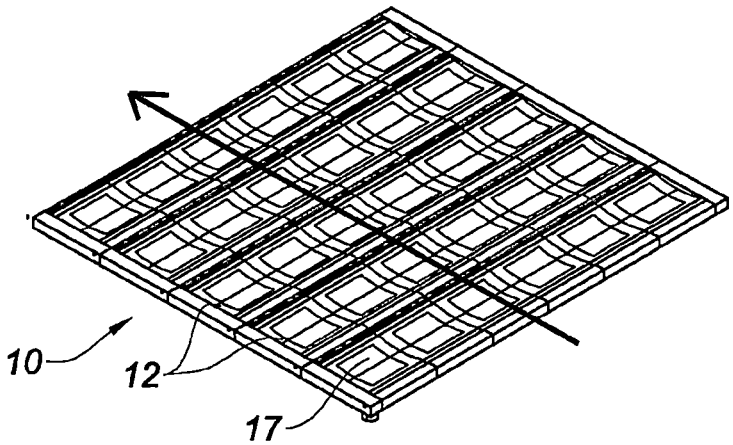
FIG. 3 shows the heat exchanger of FIG. 2 in a state in which the heat-conductive elements are folded down into the inactive position.
Figure 4:
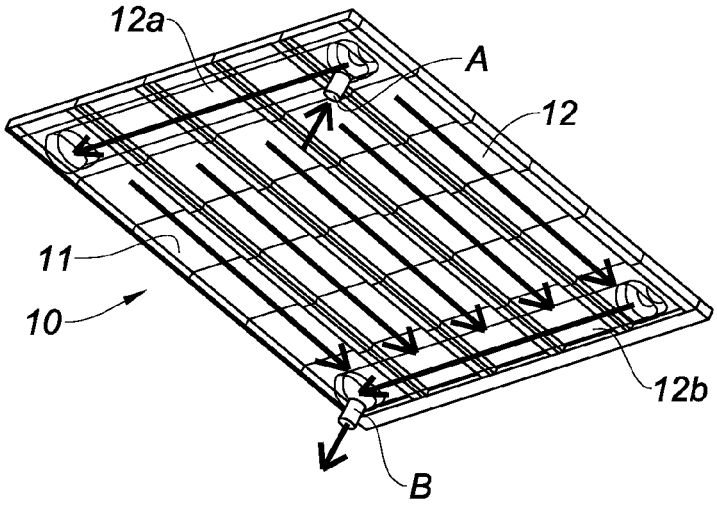
FIG. 4 shows the heat exchanger of the invention viewed from below from the side of the fluid collectors.
Figure 5:
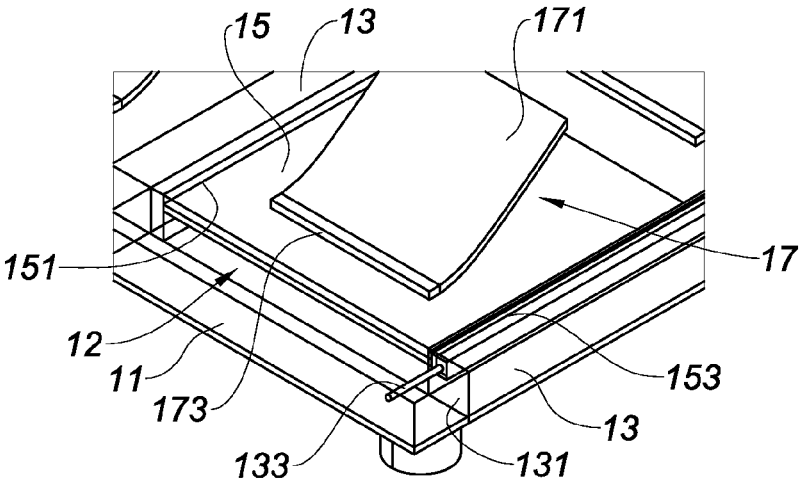
FIG. 5 is a detail view of the exchanger of FIG. 2 with a conductive element in the active position; the interior is visible by transparency.
Figure 6:
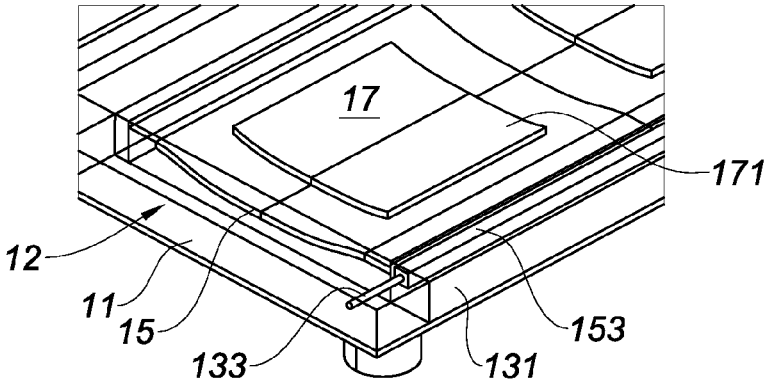
FIG. 6 is a view of the exchanger of FIG. 3 with a heat-conductive element in the inactive position; the interior is visible by transparency.

The membrane 15 is selected from a preferably metallic material for the heat conduction and impact strength properties thereof. The membrane is arranged so that it can be deformed by the movement of the piston between a first position in which it is not subjected to pressure from the control fluid and a second position in which it is pushed back by the control fluid introduced into the actuator chamber. In the first position of the piston, the membrane is planar, as can be seen in FIG. 2. In the second position, the membrane is curved, as can be seen in FIG. 3. It has assumed the shape of a portion of a cylinder.

The heat-conductive elements 17 are also produced from a material which is preferably metallic for the heat conduction and impact strength properties thereof. Non-limiting examples of materials are aluminium or a nickel-based alloy. Preferably aluminium is selected for temperatures of less than 200° C., and nickel-based alloys such as Inconel® for higher temperatures.

The blades 171 forming the elements 17 have a shape which is curved around the connecting edge connecting the blades 171 to the membrane. This curved shape is achieved by plastic deformation about an axis parallel to the line of the connecting edge. According to one embodiment, the blade is a laminated composite formed of a stack of two sheets, one of the two sheets having been heated before being glued to the second. After it has returned to ambient temperature and after the gluing, the composite blade is prestressed. This example is non-limiting. A simple blade which is folded or dished will suffice insofar as it is capable of assuming the two positions.

As can be seen in FIGS. 2 to 6, the membrane 15 covering the channels 12 is provided with a plurality of blades 171 fixed along connecting edges which are perpendicular to the direction of the channels.

At rest, when it is not subjected to the control fluid, the membrane is planar and the connecting edges are rectilinear. The blades 171 are then in their inoperative form, and curved around the connecting edges 173.

When the actuator chambers 133 are supplied with control fluid, the pistons are pushed back in the direction of the opposite partition 13, resulting in the deformation of the membrane 15, which assumes a hollowed shape. The connecting edges, being rigidly connected to the membrane, follow the deformation thereof. The deformation of the connecting edges brings about that of the blades, the curvature of which matches that of the membrane. It follows that the blades are flattened against the membrane. There is thus a simple and robust means of moving the blades forming the heat-conductive elements between an active position in which they are raised relative to the membrane and an inactive position in which the heat conduction surface is reduced.

Such an exchanger may be used within the secondary flow path of a turbofan engine. The cold air of the flow path is the first fluid. The fluid to be cooled is made to circulate within the channels, forming the second fluid. When the cooling of the second fluid has priority, the membrane of the exchanger is kept planar, and the heat-conductive elements are then in the active position. When the cooling does not have priority, the control fluid is introduced into the actuator chamber, resulting in the movement of the piston, the deformation of the membrane and the change in curvature of the blades, which assume an inactive position.

The invention claimed is:

1. A heat exchanger for heat exchange between a first fluid and a second fluid, comprising a membrane separating the two fluids and a heat-conductive element in thermal contact with both the membrane and the first fluid, said heat-conductive element being movable between an active position and an inactive position such that the capacity of heat exchange with the first fluid is less in the inactive position than in the active position, wherein the heat-conductive element is in the form of a blade, the blade being rigidly connected to the membrane by a connecting edge, wherein said element is prestressed in the active position and the transition from the active position to the inactive position is achieved by deforming the membrane along the connecting edge connecting the blade to the membrane, the deformation of the membrane being achieved by applying a force that is parallel to the plane of the membrane, and comprising a piston by means of which the force is applied to the membrane.

2. The heat exchanger according to claim 1, wherein in the active position, the blade is moved away from the membrane so as to be in contact with the first fluid by the two faces thereof.

3. The heat exchanger according to claim 2, wherein in the inactive position the blade is arranged by one face close to the membrane.

4. The heat exchanger according to claim 2, wherein in the active position the blade has a curved shape which moves away from the membrane at the connecting edge.

5. The heat exchanger according to claim 4, wherein the connecting edge is rectilinear and the blade is curved around the connecting edge in the active position.

6. The heat exchanger according to claim 1, wherein the deformation of the membrane is achieved by applying a compressive force.

7. A turboshaft engine comprising a heat exchanger according to claim 1.

* * * * *